US007934571B2

(12) United States Patent
Chiu et al.

(10) Patent No.: US 7,934,571 B2
(45) Date of Patent: May 3, 2011

(54) MOVING BASE FOR ROBOTIC VACUUM CLEANER

(76) Inventors: Jane-Ferng Chiu, Tucheng (TW); Cheng-Han Shieh, Tucheng (TW); Ching-Kuo Wang, Tucheng (TW)

( * ) Notice: Subject to any disclaimer, the term of this patent is extended or adjusted under 35 U.S.C. 154(b) by 54 days.

(21) Appl. No.: 12/554,108

(22) Filed: Sep. 4, 2009

(65) Prior Publication Data

US 2011/0056759 A1 Mar. 10, 2011

(51) Int. Cl.
*B62D 6/00* (2006.01)
*A47L 5/00* (2006.01)

(52) U.S. Cl. ..... 180/6.2; 180/6.54; 180/6.66; 180/168; 318/568.12; 318/567; 318/587; 15/319

(58) Field of Classification Search ..... 180/6.2, 180/6.54, 6.66, 168; 318/568.12, 567, 587; 15/319

See application file for complete search history.

(56) References Cited

U.S. PATENT DOCUMENTS 3,823,791 A * 7/1974 Sheler ..... 180/6.66
5,771,987 A * 6/1998 Marbach ..... 180/6.66
7,248,951 B2 * 7/2007 Hulden ..... 701/23
7,429,843 B2 * 9/2008 Jones et al. ..... 318/568.12
7,568,536 B2 * 8/2009 Yu et al. ..... 180/6.2
7,761,954 B2 * 7/2010 Ziegler et al. ..... 15/320
2008/0174268 A1 * 7/2008 Koo et al. ..... 320/109

* cited by examiner

*Primary Examiner* — Paul N Dickson
*Assistant Examiner* — Marlon A Arce
(74) *Attorney, Agent, or Firm* — Shimokaji & Associates, P.C.

(57) ABSTRACT

A moving base for robotic vacuum cleaner includes a base; a motor mounted in a motor chamber on the base to alternatively drive a drive shaft thereof to rotate clockwise or counterclockwise; a primary wheel fixed to and rotating along with the drive shaft of the motor; a clutch assembly connected to the primary wheel; an axle connected at an end to the clutch assembly, so as to be driven by the primary wheel to rotate when the drive shaft of the motor rotates clockwise, or to disengage from the driving by the primary wheel when the drive shaft of the motor rotates counterclockwise: and a secondary wheel connected to another end of the axle to rotate along with the axle. Since only one motor is needed to control a moving direction thereof, the robotic vacuum cleaner can have effectively reduced manufacturing cost and overall volume.

9 Claims, 8 Drawing Sheets

MOVING BASE FOR ROBOTIC VACUUM CLEANER

BACKGROUND OF THE INVENTION

1. Field of the Invention

The present invention relates to a moving mechanism, and more particularly, to a moving base mounted on a bottom of a robotic vacuum cleaner to effectively reduce the manufacturing cost and volume of the robotic vacuum cleaner.

2. Description of the Prior Arts

Following the constant developments in the technical field of automation, various kinds of automated devices have been researched and developed to bring more conveniences to people's life. One of the best examples of such automated devices is the robotic vacuum cleaner, which is an automated mechanical device and can automatically move for cleaning the floor.

Generally, the robotic vacuum cleaner includes two parallelly spaced wheels mounted on a bottom thereof. Each of the two wheels is controlled by a driving motor mounted thereon to move forward and backward. When the robotic vacuum cleaner meets an obstacle while moving forward, the left wheel is driven by its motor to rotate reversely while the right wheel is driven by its motor to rotate forward, so that the cleaner pivotally turns counterclockwise. Alternatively, the right wheel is driven to rotate reversely while the left wheel is driven to rotate forward, so that the cleaner pivotally turns clockwise. When the cleaner has been reoriented to a direction facing away from the obstacle, the motors drive the two wheels to rotate forward again to move away from the obstacle.

However, using two motors on the robotic vacuum cleaner to separately control the wheels to rotate will inevitably increase the manufacturing cost of the cleaner. Meanwhile, the two motors also occupy extra space in the cleaner to adversely increase the volume thereof.

SUMMARY OF THE INVENTION

A primary object of the present invention is to overcome the problems in the conventional robotic vacuum cleaner by providing a structurally improved moving base for robotic vacuum cleaner, so that the number of driving motors used to control the wheels of the cleaner can be reduced to one.

The moving base for robotic vacuum cleaner includes a base; a motor mounted in a motor chamber on the base to alternatively drive a drive shaft thereof to rotate clockwise or counterclockwise; a primary wheel fixed to and rotating along with the drive shaft of the motor; a clutch assembly connected to the primary wheel; an axle connected at an end to the clutch assembly, so as to be driven by the primary wheel to rotate when the drive shaft of the motor rotates clockwise, or to disengage from the driving by the primary wheel when the drive shaft of the motor rotates counterclockwise; and a secondary wheel connected to another end of the axle to rotate along with the axle. Since only one motor is needed to control a moving direction thereof, the robotic vacuum cleaner can have effectively reduced manufacturing cost and overall volume.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
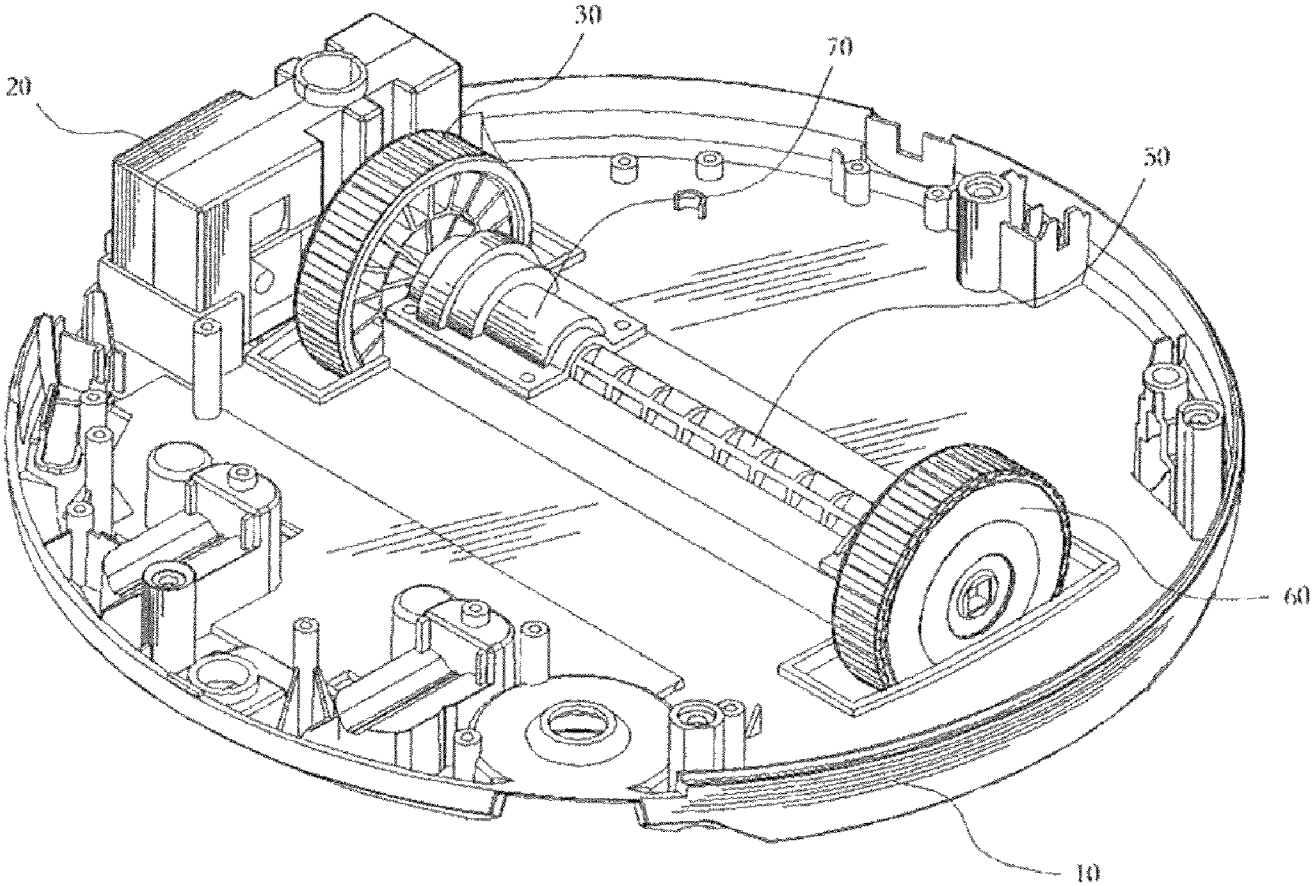
FIG. 1 is a top perspective view of a moving base for robotic vacuum cleaner according to a preferred embodiment of the present invention.
Figure 2:
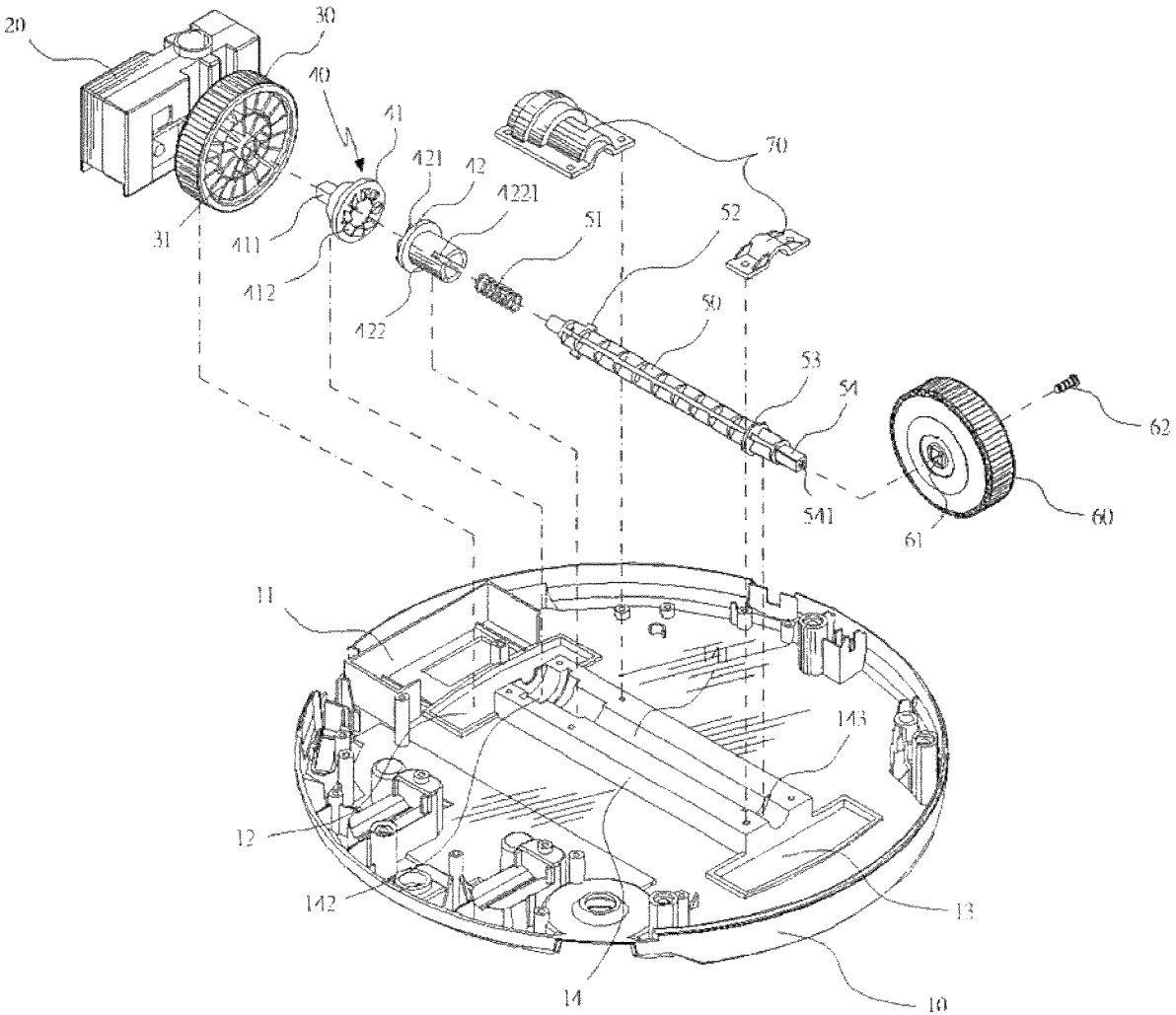
FIG. 2 is an exploded view of FIG. 1.
Figure 3:
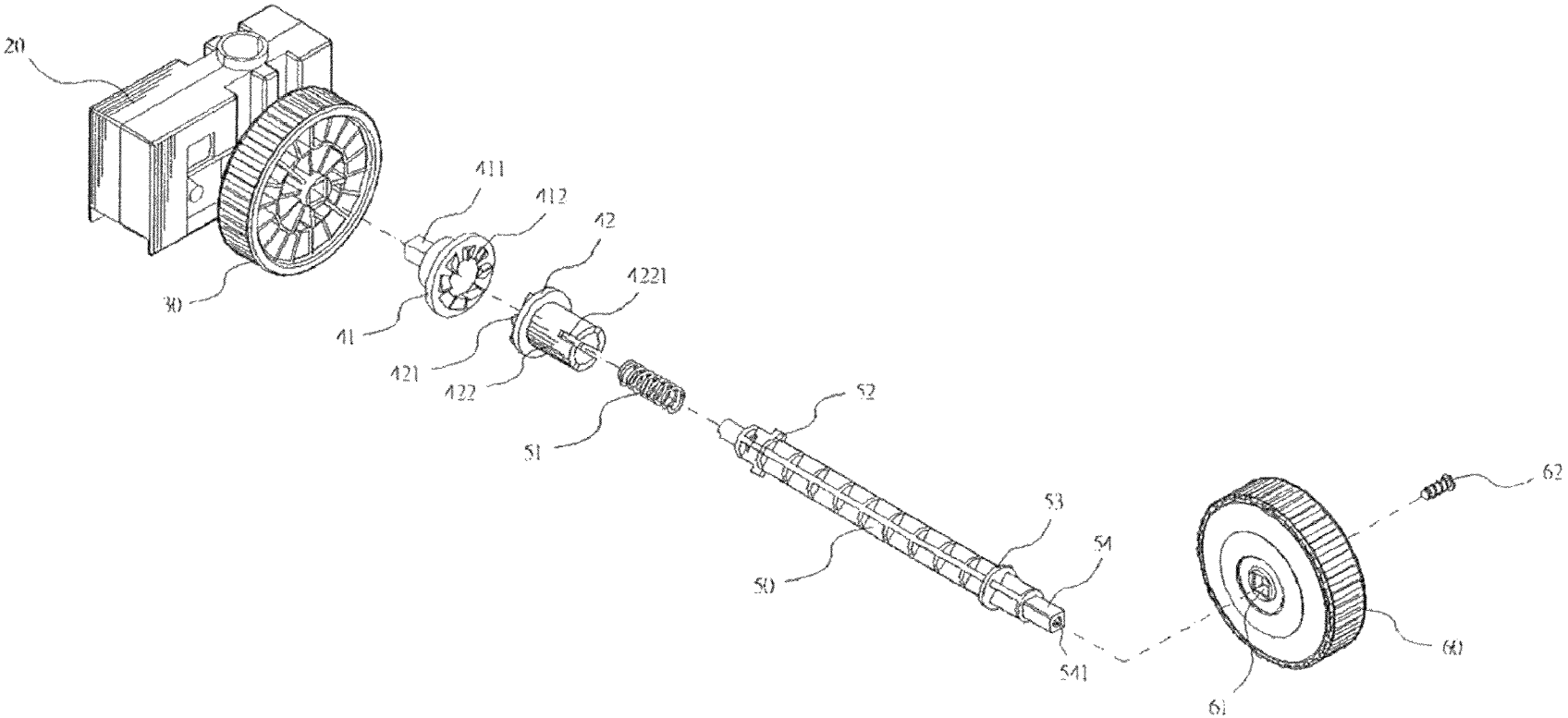
FIG. 3 is an exploded perspective view showing some of the components for the present invention.

Please refer to FIGS. 1 to 3. A moving base for robotic vacuum cleaner according to a preferred embodiment of the present invention includes a base 10, a motor 20, a primary wheel 30, a clutch assembly 40, an axle 50, a secondary wheel 60, and two limiting members 70.

The base 10 may be a circular pan-shaped base, which has a motor chamber 11, a primary wheel opening 12, a secondary wheel opening 13, and an axle-holding seat 14. The motor chamber 11 is located near one side on the base 10. The primary wheel opening 12 is a through hole formed on the base 10 and located to a radially inner side of the motor chamber 11. The secondary wheel opening 13 is a through hole formed on the base 10 and located near another side on the base 10 diametrically opposite to the primary wheel opening 12. The axle-holding seat 14 is an elongated seat extended between the primary and the secondary wheel opening 12, 13, and has an elongated recess 141, a clutch chamber 142, and a stop slot 143 formed on a top thereof. The elongated recess 141 longitudinally extends a full length of the axle-holding seat 14; the clutch chamber 142 is downward extended from the elongated recess 141 and located adjacent to the primary wheel opening 12; and the stop slot 143 is transversely formed in the elongated recess 141.

The motor 20 is securely mounted in the motor chamber 11 for driving a drive shaft thereof to rotate clockwise or counterclockwise.

The primary wheel 30 is disposed in the primary wheel opening 12 and mounted on the drive shaft of the motor 20 to rotate along with the drive shaft when the same is driven by the motor 20 to rotate clockwise or counterclockwise, so as to bring the robotic vacuum cleaner to move. A shaft-receiving portion 31 is formed on and centered at one side of the primary wheel 30 opposite to the motor 20. The shaft-receiving portion 31 may be a rectangular receiving hole having a predetermined depth.

Figure 4:
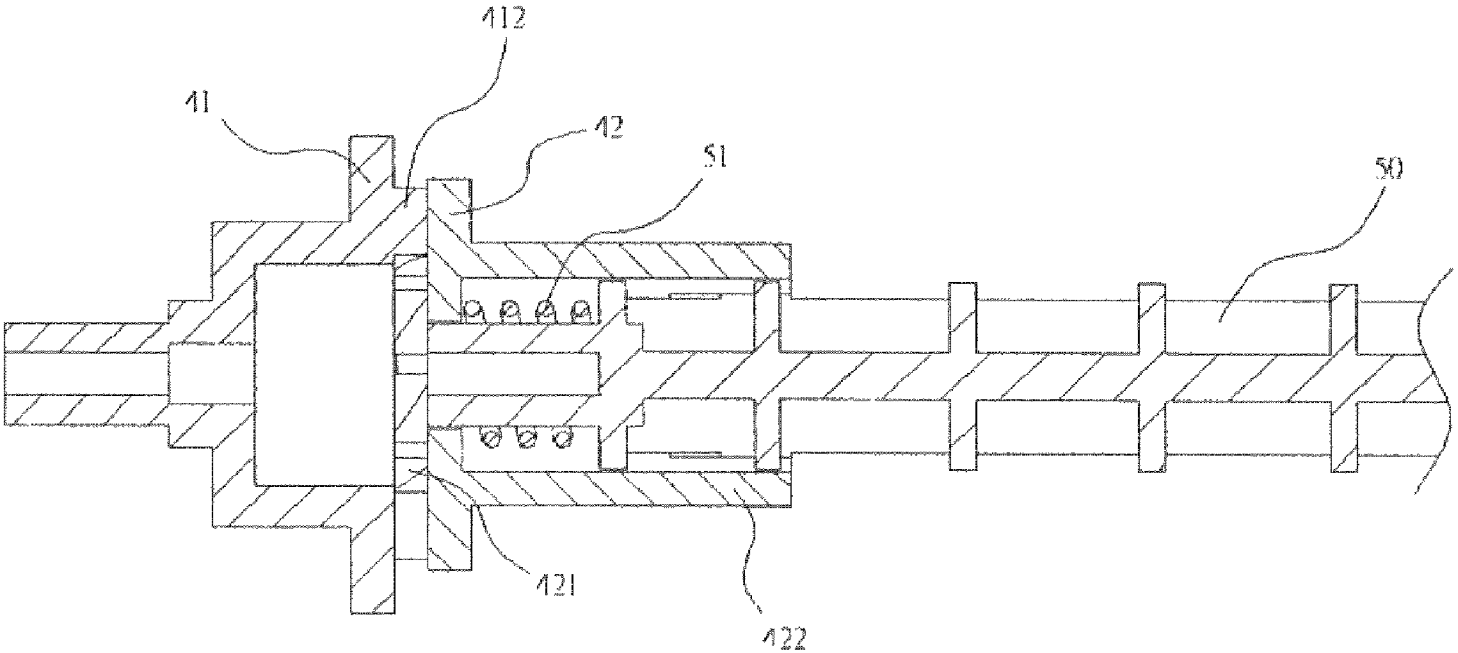
FIG. 4 is an assembled sectioned side view showing some of the components fort the present invention.

Please also refer to FIG. 4. The clutch assembly 40 is rotatably fitted in the clutch chamber 142, and includes a driving member 41 and a driven member 42.

The driving member 41 is provided on an outer side facing toward the primary wheel 30 with a fixing shaft 411, which has a free end being configured corresponding to that of the shaft-receiving portion 31 on the primary wheel 30 for securely engaging with the shaft-receiving portion 31 to allow the driving member 41 to coaxially rotate along with the primary wheel 30. An inner side of the driving member 41 facing toward the secondary wheel 60 is a contact face, on which multiple circumferentially spaced clutch teeth 412 is provided. Since the provision of clutch teeth 412 for driving two rotating elements to engage with or disengage from each other is a known technical means, it is not discussed in details herein, and only the arrangement of the clutch teeth 412 in the moving base of the present invention is described.

The driven member 42 is configured to selectively cooperate with the driving member 41. The driven member 42 is provided on an outer side facing toward the driving member 41 with multiple clutch teeth 421 corresponding to the clutch teeth 412 on the driving member 41. When the primary wheel 30 and the driving member 41 rotate clockwise, the clutch teeth 421 on the driven member 42 will engage with the clutch teeth 412 on the driving member 41, so that the driven member 42 is driven by the driving member 41 to rotate clockwise, too. On the other hand, when the primary wheel 30 and the driving member 41 rotate counterclockwise, the clutch teeth 421 will disengage from the clutch teeth 412, so that the driven member 42 is no longer driven by the driving member 41 to rotate. A sleeve portion 422 is axially projected from an inner side of the driven member 42 facing toward the secondary wheel 60, and multiple spaced elongated slits 4221 are formed on a free end of the sleeve portion 422 to axially extend inward from the free end by a predetermined distance.

The axle 50 is a long rod for fitly seated in the elongated recess 141. A first end of the axle 50 is correspondingly extended into the sleeve portion 422 of the driven member 42 of the clutch assembly 40. An elastic element 51, which may be a spring, is arranged in the sleeve portion 422 to locate between and press against an inner bottom thereof and the first end of the axle 50, so that the driven member 42 is pushed by the elastic element 51 to normally connect to the driving member 41. The axle 50 is provided at the first end on an outer peripheral surface thereof with multiple engaging blocks 52 for axially slidably engaging with the elongated slits 4221 while interfering with the elongated slits 4221, so that the axle 50 and the driven member 42 form an integral body to rotate together. The axle 50 is formed at a predetermined position with a stop collar 53 for correspondingly engaging with the stop slot 143 in the elongated recess 141, so as to stop the axle 50 from moving axially in the elongated recess 141. A connecting section 54 is formed at a second end of the axle 50 opposite to the first end thereof. The connecting section 54 has a non-circular cross-sectional shape, and is provided at an end face thereof with a fixing hole 541, which may be an internally threaded hole, for example.

The secondary wheel 60 is correspondingly disposed in the secondary wheel opening 13 to parallel with the primary wheel 30, so as to cooperate with the primary wheel 30 to move the robotic vacuum cleaner. The secondary wheel 60 is provided at a center thereof with a connecting hole 61, which is a through hole, for securely engaging with the connecting section 54 of the axle 50, so that the secondary wheel 60 can coaxially rotate along with the axle 50 and the driven member 42. A fastening element 62, such as a screw, may be externally extended from an outer side of the secondary wheel 60 into the fixing hole 541 to securely connect the secondary wheel 60 to the second end of the axle 50.

The two limiting members 70 are separately mounted over the clutch assembly 40 and the axle 50, and are securely mounted to wall portions on the top of the axle-holding seat 14, so as to firmly hold the clutch assembly 40 and the axel 50 down in the clutch chamber 142 and the elongated recess 141, respectively.

Figure 5:
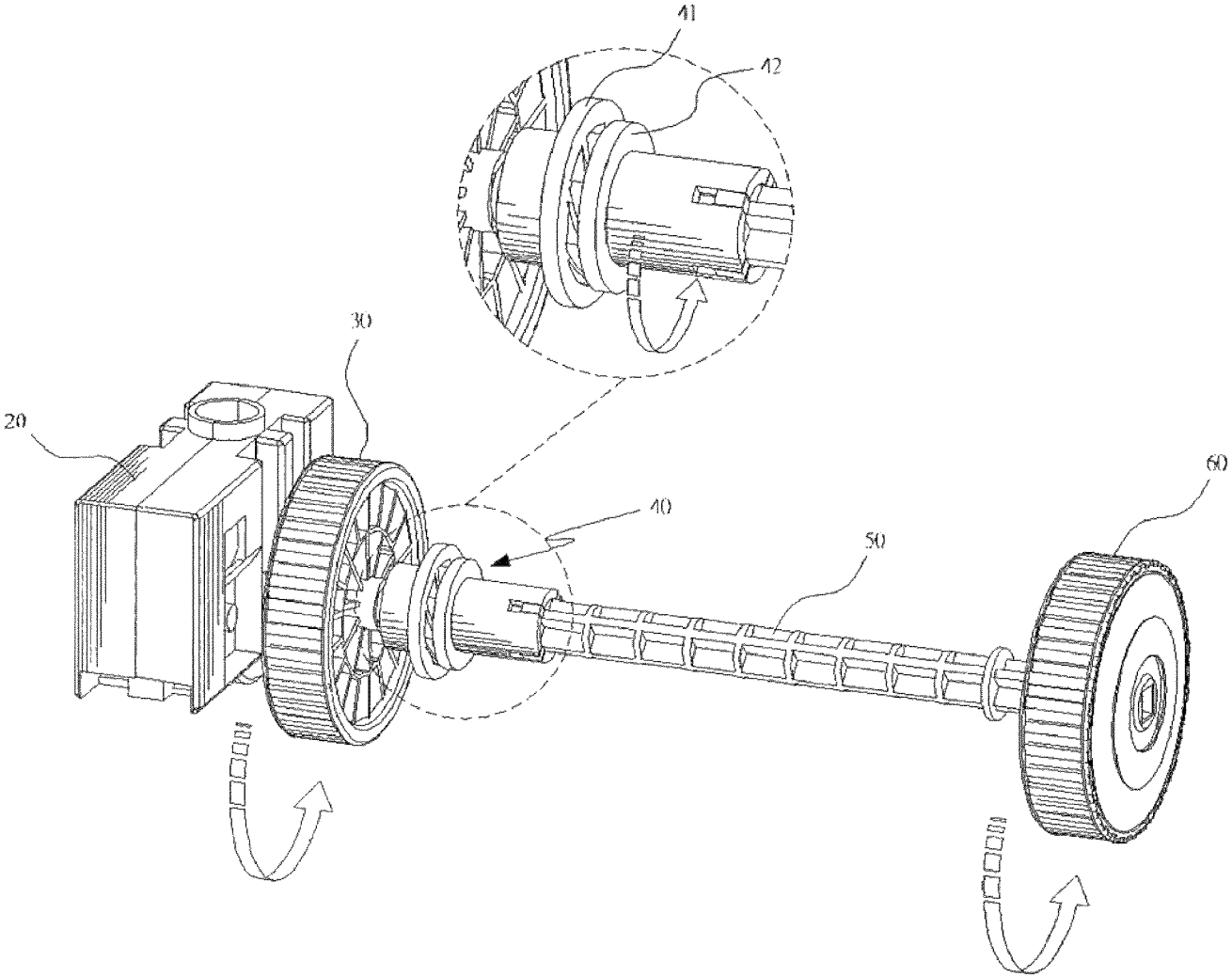
FIGS. 5 and 6 show the manner in which the moving base of the present invention moves forward.
Figure 6:
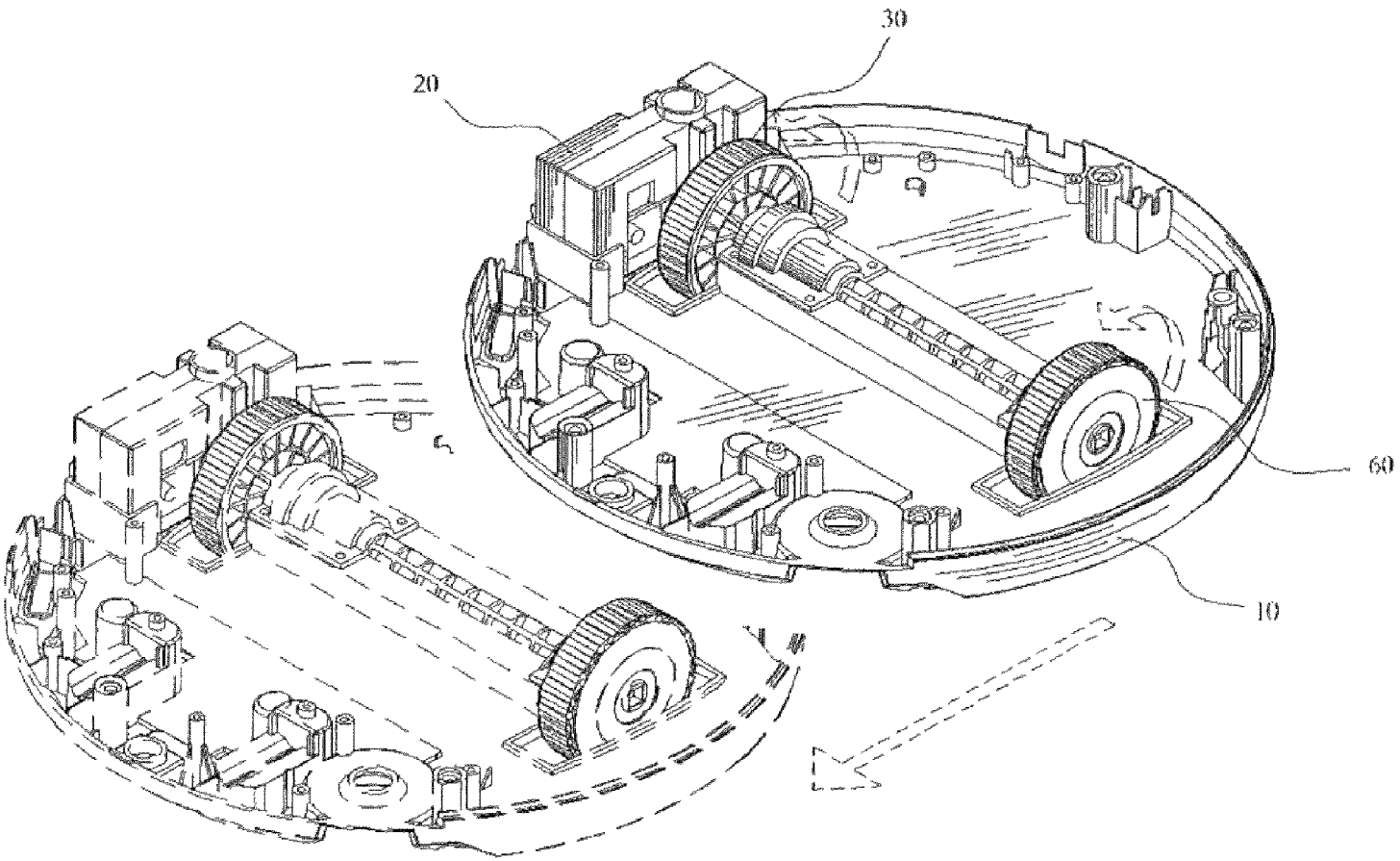

Please further refer to FIGS. 5 and 6. For the moving base for robotic vacuum cleaner according to the present invention to move forward, the motor 20 is actuated to drive the primary wheel 30 to rotate clockwise. Then, through the gearing function of the clutch assembly 40, the axle 50 and the secondary wheel 60 are further driven to rotate clockwise at the same time, bringing the parallel primary and secondary wheels 30, 60 to rotate clockwise synchronously and thereby cause the robotic vacuum cleaner to move forward.

Figure 7:
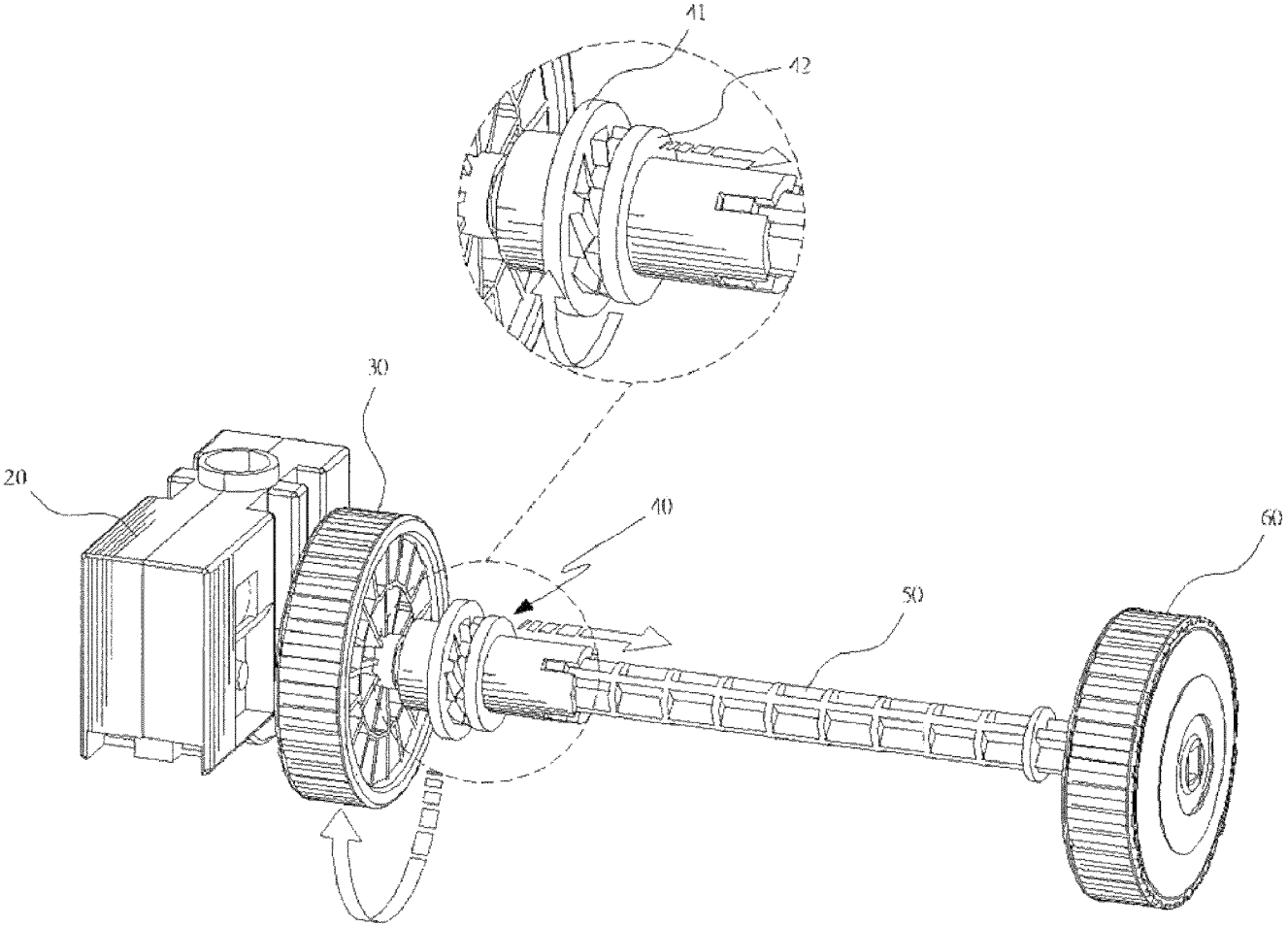
FIGS. 7 and 8 show the manner in which the moving base of the present invention reorients.
Figure 8:
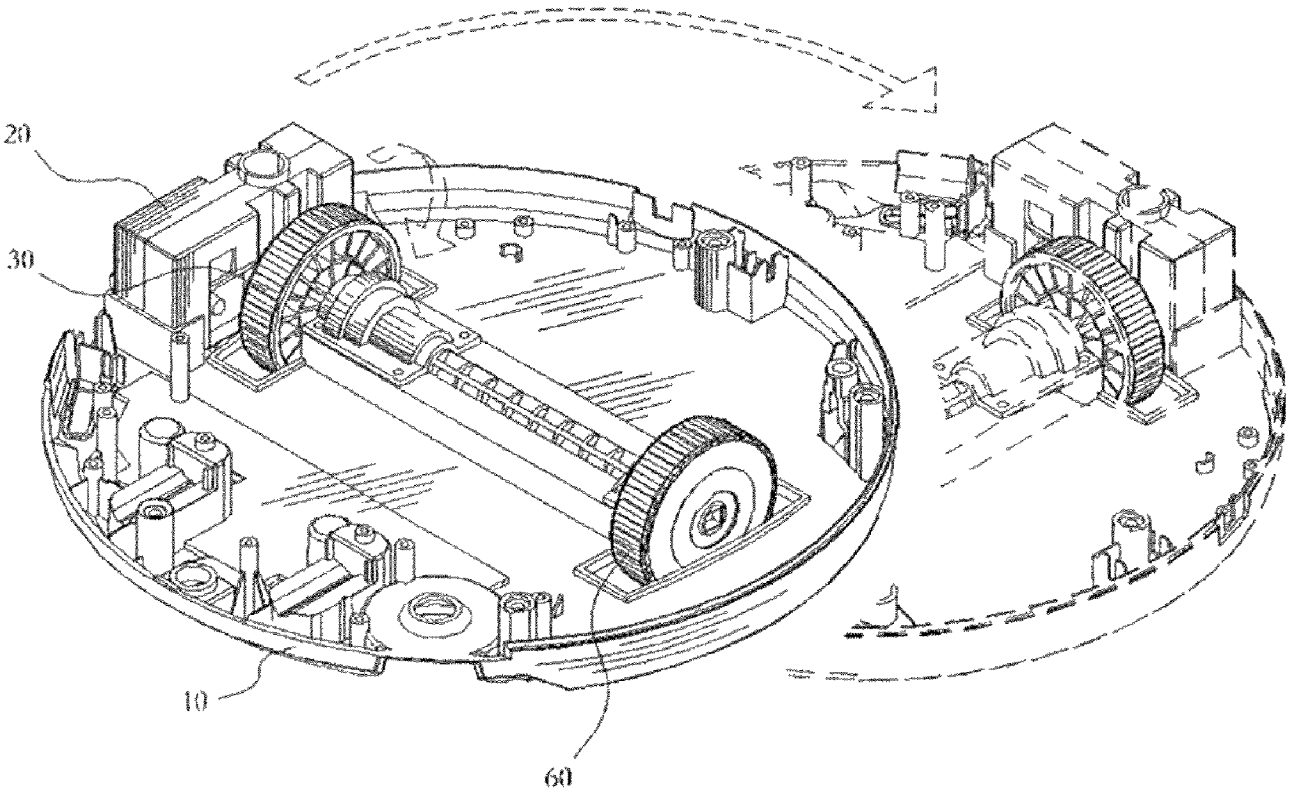

Please refer to FIGS. 7 and 8. When the robotic vacuum cleaner touches an obstacle while moving forward, the motor 20 will drive the primary wheel 30 to rotate counterclockwise. At this point, the clutch teeth 412 and the clutch teeth 421 of the clutch assembly 40 disengage from one another, and the axle 50 and the secondary wheel 60 are no longer driven by the primary wheel to rotate, such that the secondary wheel 60 is immovable at the same place while the primary wheel 30 rotates counterclockwise alone to move backward. As a result, the whole robotic vacuum cleaner is turned about the secondary wheel 60 to a direction facing away from the obstacle. Thereafter, the primary and the secondary wheel 30, 60 are driven again by the motor 20 to synchronously rotate clockwise to move the robotic vacuum cleaner away from the obstacle.

In the moving base for robotic vacuum cleaner according to the present invention, since only one motor 20 is used as a power source to control the primary and the secondary wheel 30, 60, both the manufacturing cost and the space needed for accommodating components of the robotic vacuum cleaner are advantageously reduced, compared to the conventional robotic vacuum cleaner that requires two motors to drive two wheels to achieve the purpose of changing moving direction.

Moreover, to assist the robotic vacuum cleaner in changing moving direction in a more effective manner, in another embodiment of the present invention, the primary wheel 30 has an outer diameter larger than an outer diameter of the secondary wheel 60, so that the moving base of the present invention moves forward along a curved path during normal operation thereof. In the event the robotic vacuum cleaner touches or collides with an obstacle, the curved path is more helpful in reversing the primary wheel 30 to achieve the purpose of reorientation and then moving the whole moving base backward.

What is claimed is:

1. A moving base for robotic vacuum cleaner, comprising:

a base having a motor chamber, a primary wheel opening, a secondary wheel opening and an axle-holding seat having an elongated recess and a clutch chamber;

a motor being mounted in the motor chamber and alternatively driving a drive shaft thereof to rotate clockwise or counterclockwise;

a primary wheel being disposed in the primary wheel opening, being securely attached to the drive shaft of the motor and rotating with the drive shaft;

a clutch assembly being correspondingly disposed in the clutch chamber to rotate along with the primary wheel and the drive shaft of the motor;

an axle being correspondingly disposed in the elongated recess on the axle-holding seat, and a first end of the axle being connected to the clutch assembly; whereby, through a gearing function of the clutch assembly, the axle being driven by the primary wheel to rotate when the drive shaft of the motor rotates clockwise, and the axle disengaging from the driving by the primary wheel when the drive shaft of the motor rotates counterclockwise;

a secondary wheel being disposed in the secondary wheel opening, being parallel with the primary wheel, and being securely attached to a second end of the axle to rotate along with the axle; and at least one limiting member being mounted over the clutch assembly and the axle, and being securely mounted to wall portions on the top of the axle-holding seat for firmly holding the clutch assembly and the axle down in the clutch chamber and the elongated recess on the axle-holding seat, respectively.

2. The moving base for robotic vacuum cleaner as claimed in claim 1, wherein the motor chamber is located on one side of the base, the primary wheel opening is a through hole formed on the base at a radially inner side of the motor chamber, the secondary wheel opening is a through hole formed on the base near one side of the base diametrically opposite to the primary wheel opening, the axle-holding seat is located and extended between the primary and the secondary wheel opening and the clutch assembly is connected to the primary wheel.

3. The moving base for robotic vacuum cleaner as claimed in claim 2, wherein the primary wheel is provided on one side opposite to the motor with a centered shaft-receiving portion;

the clutch assembly includes a driving member and a driven member; the driving member being provided on an outer side facing toward the primary wheel with a fixing shaft, which is securely engaged with the shaft-receiving portion on the primary wheel to allow the driving member to coaxially rotate along with the primary wheel, and on an inner side facing toward the secondary wheel with multiple circumferentially spaced clutch teeth; the driven member being provided on an outer side facing toward the driving member with multiple clutch teeth corresponding to the clutch teeth on the driving member; whereby when the primary wheel rotates clockwise, the clutch teeth on the driven member engaging with the clutch teeth on the driving member, and when the primary wheel rotates counterclockwise, the clutch teeth on the driven member disengaging from the clutch teeth on the driving member; and a sleeve portion being axially projected from an inner side of the driven member facing toward the secondary wheel;

the first end of the axle is extended into the sleeve portion of the driven member to interfere with the sleeve portion, allows the axle and the driven member to coaxially rotate together; and an elastic element being arranged in the sleeve portion to locate between and pressing against an inner bottom of the sleeve portion and the first end of the axle; and a connecting section being formed at a second end of the axle opposite to the first end thereof; and the secondary wheel is provided at a center thereof with a connecting hole being a through hole for securely engaging with the connecting section of the axle.

4. The moving base for robotic vacuum cleaner as claimed in claim 3, wherein the shaft-receiving portion on the primary wheel is a non-circular receiving hole, and the fixing shaft on the driving member has a free end being configured corresponding to that of the shaft-receiving portion on the primary wheel for securely engaging with the shaft-receiving portion.

5. The moving base for robotic vacuum cleaner as claimed in claim 3, wherein the sleeve portion on the driven member is provided at a free end thereof with multiple circumferentially spaced elongated slits; and the axle is provided at the first end on an outer peripheral surface thereof with multiple engaging blocks for axially slidably engaging with the elongated slits while interfering with the elongated slits, and the axle rotates with the driven member.

6. The moving base for robotic vacuum cleaner as claimed in claim 3, wherein the elongated recess on the base is provided with a transverse stop slot; and the axle is provided at a predetermined position with a stop collar for correspondingly engaging with the stop slot.

7. The moving base for robotic vacuum cleaner as claimed in claim 3, wherein the connecting section at the second end of the axle has a non-circular cross-sectional shape, and is provided on an end face with a fixing hole; and a fastening element being externally extended from an outer side of the secondary wheel into the fixing hole to thereby securely connect the secondary wheel to the axle.

8. The moving base for robotic vacuum cleaner as claimed in claim 3, wherein the elastic element disposed between the inner bottom of the sleeve portion and the first end of the axle is a spring.

9. The moving base for robotic vacuum cleaner as claimed in claim 3, wherein the primary wheel has an outer diameter larger than an outer diameter of the secondary wheel.

* * * * *